United States Patent [19]

Meier et al.

[11] Patent Number: 4,896,558

[45] Date of Patent: Jan. 30, 1990

[54] CONTROL HANDLE FOR A WORK VEHICLE

[75] Inventors: Lynn A. Meier, East Dubuque, Ill.; Steven H. Johnson; Mark A. Litka, both of Dubuque, Iowa

[73] Assignee: Deere & Company, Moline, Ill.

[21] Appl. No.: 200,825

[22] Filed: Jun. 1, 1988

[51] Int. Cl.[4] ..... G05G 1/10

[52] U.S. Cl. ..... 74/543; 74/548; 200/522

[58] Field of Search ..... 74/543, 548, 553, 523; 200/157, 61.85, 298, 296, 522; 16/114 R

[56] References Cited

U.S. PATENT DOCUMENTS

| | | | |
|---|---|---|---|
| 1,783,636 | 12/1930 | Tregoning | 200/298 X |
| 2,049,145 | 7/1936 | Warren et al. | 74/543 X |
| 2,519,726 | 8/1950 | Wollard | 200/157 |
| 2,543,450 | 2/1951 | Feagin | 200/157 X |
| 2,611,042 | 9/1952 | Napoli, Jr. | 200/157 X |
| 3,142,227 | 7/1964 | Stringer | 200/157 X |
| 3,381,104 | 4/1968 | Abell et al. | 200/157 |
| 3,603,748 | 9/1971 | Cryer | 200/157 X |
| 3,867,600 | 2/1975 | Phillips | 200/157 |
| 4,057,701 | 11/1977 | Sisk et al. | 200/157 |
| 4,105,882 | 8/1978 | Ulbing et al. | 200/157 |
| 4,198,721 | 4/1980 | Copeland | 200/157 X |
| 4,216,363 | 8/1980 | Nofel | 200/157 |
| 4,501,424 | 2/1985 | Stone et al. | 200/157 X |
| 4,520,256 | 5/1985 | Doyle | 200/157 X |
| 4,655,649 | 4/1987 | Itzov et al. | 200/157 X |
| 4,683,369 | 7/1987 | Rieckmann et al. | 200/157 X |
| 4,710,599 | 12/1987 | Motodate et al. | 200/61.85 |
| 4,755,100 | 7/1988 | Schultz et al. | 200/157 X |

OTHER PUBLICATIONS

John Deere 693B Feller-Buncher Operator's Manual, 4/1987.

*Primary Examiner*—Rodney M. Lindsey

[57] ABSTRACT

A control handle for an actuating lever having a plurality of electrical control switches mounted thereon. The control handle comprises a housing having a shaft portion and a control face portion that are formed from a switch plate and a back plate that are held together by self-tapping screws. The switch plate is provided with a hexagonal coupling member that is provided with a threaded longitudinal bore for engaging an actuating lever. The back plate is provided with terminal posts that are electrically coupled to a wiring harness extending up through the control handle and the switches. The switches can be mounted in various mounting orientations as desired by the operator.

16 Claims, 2 Drawing Sheets

CONTROL HANDLE FOR A WORK VEHICLE

BACKGROUND OF THE INVENTION

1. Field of the Invention

The invention is directed to a control lever for a work vehicle having at least one electrical control switch. The control handle and its electrical control switch can be readily serviced in the field and its orientation can be changed for individual operator preferences.

2. Description of the Prior Art

Large work vehicles, such as a crawler feller buncher, perform a number of work operations. An operator located in the cab of such a machine must manipulate a number of levers and switches to complete an operation cycle. To reduce operator fatigue and increase productivity, it is desirable to minimize the number of hand placements an operator must make during a work operation.

Previously floor pedals have been used to actuate some of the feller buncher operations together with hand operated actuating levers. The actuating levers can be provided with joystick-shaped control handles. By manipulating the position of the handles, the positioning and operation of the feller buncher can be controlled. Such control handles can be provided with top mounted electrical switches for controlling additional feller buncher operations.

SUMMARY OF THE INVENTION

It is one of the objects of the present invention to provide a control handle for an actuating lever, having electrical control switches that are easily manipulated by the operator.

It is another object of the present invention to provide a control handle that can be readily serviced in the field, without the control handle being removed from the actuating lever.

As such, the control handle comprises a housing defining an elongated shaft portion and a control face that is screwed onto an actuating lever. The housing is formed from two plastic plates, a switch plate and a back plate that are held together by self-tapping screws. An electrical rocker control switch is mounted in the control face formed by the switch plate. A wiring harness having a plurality of communication wires passes up through elongated shaft portion of the housing to the back plate where it is secured to terminal posts located on the back plate. Switch wires extend from the switch to the terminal posts so that they are in electrical contact with the communication wires of the wiring harness. In this way, when the back plate is detached from the switch plate, the terminal posts and electrical switch can be readily serviced.

A metallic hexagonal coupling member is located in the shaft portion of the switch plate and held in place by two self-tapping screws. The hexagonal member is provided with an elongated internal threaded bore which is used to secure the control handle to the actuating lever of the work vehicle. The hexagonal member is provided with lateral apertures which are mounted on plastic posts formed in the switch plate. The self-tapping screws are secured to the posts through these apertures. In addition, a post extends from the back plate to engage one of the apertures formed in the hexagonal member to facilitate fabricating the handle. The hexagonal member has a rounded tip to prevent it from cutting the communication wires and a circumferential groove around which a tie band is wrapped for holding the harness to the hexagonal member.

To facilitate operator comfort in manipulating the rocker switches, they are provided with an adjustable mounting means so they can be selectively oriented as desired by the operator. The switch plate of the housing is provided with a circular opening in which the rocker switch is located. A mounting ring formed in the rocker switch provides a mounting surface engaging the edge of the opening. The switch is also provided with a flat surface for defining a specific orientation. The switch is clamped in position by a washer and nut which engages the other side of the switch plate opposite the mounting ring. As such, the rocker switch can be selectively positioned and then tightened in place to the desired orientation. To facilitate assembly, two positions are preselected. These positions are a vertical orientation and a horizontal orientation. These positions are defined by grooves formed in the switch plate. A pin is selectively inserted in either of these grooves and engages the flat surface of the switch to define these two mounting orientations.

DETAILED DESCRIPTION

Figure 1:
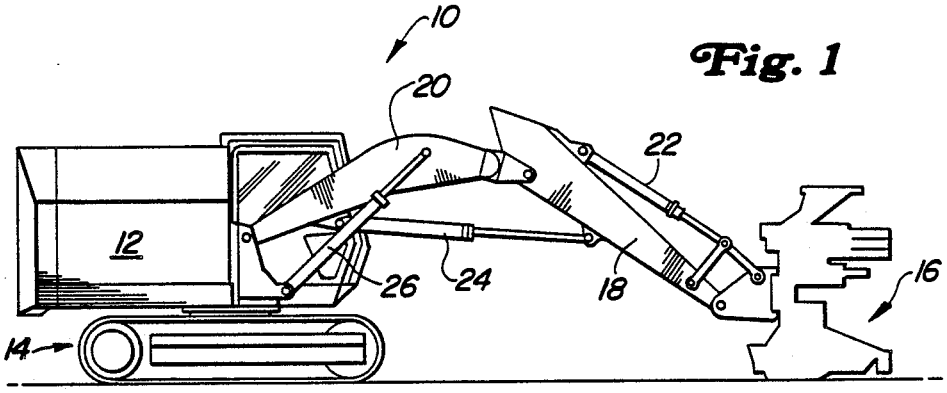
FIG. 1 is a side view of a crawler feller buncher.

Self-propelled crawler feller buncher 10, illustrated in FIG. 1, is provided with a supporting structure 12 which rests upon undercarriage 14 for transporting the feller buncher. The operating assembly 16 of the feller buncher is pivotally mounted to the end of dipper stick 18 which in turn is pivotally mounted to boom 20. Hydraulic cylinder 22 is used for pivoting assembly 16 relative to dipper stick, hydraulic cylinder 24 for pivoting the dipper stick relative to the boom, and hydraulic cylinder 26 for pivoting the boom relative to the supporting structure. The supporting structure can be pivoted relative to the undercarriage by a hydraulic motor (not shown). Although the present invention is being described for use in a crawler feller buncher, to which it is particularly well suited, it should not be limited to the feller bunchers and has a wider range of applications.

Figure 2:
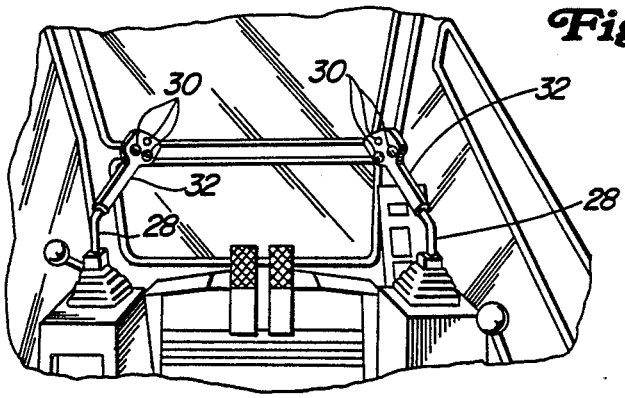
FIG. 2 is a view from inside the cab, of the controls of the feller buncher.

The pivoting movement of the supporting structure, boom, dipper stick and assembly 16 relative to the dipper stick is controlled by the positioning of actuating levers 28 located in the cab of the feller buncher, illustrated in FIG. 2. Switches 30 located on control handles 32 are used to control the operation of assembly 16. More specifically, these switches may control tilting of assembly 16 to the right and left, and actuation of the accumulators.

Figure 3:
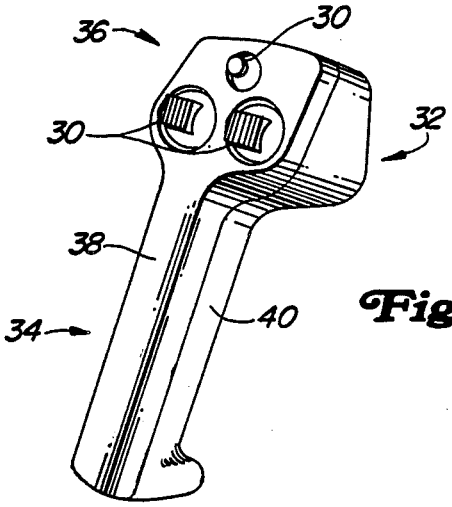
FIG. 3 is a perspective view of the control handle.
Figure 4:
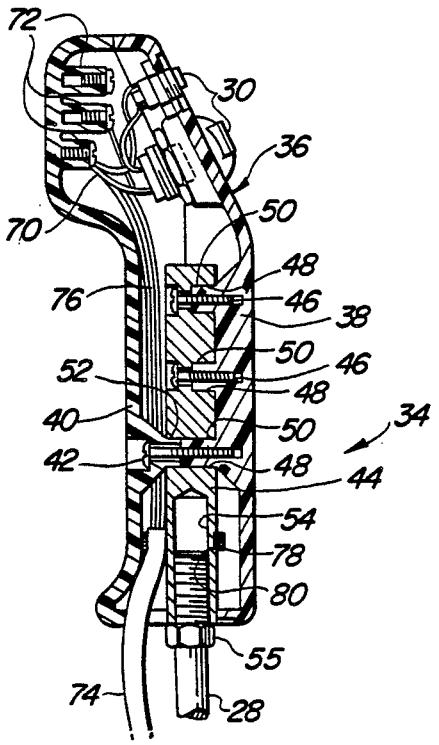
FIG. 4 is cross sectional view of the control handle.
Figure 5:
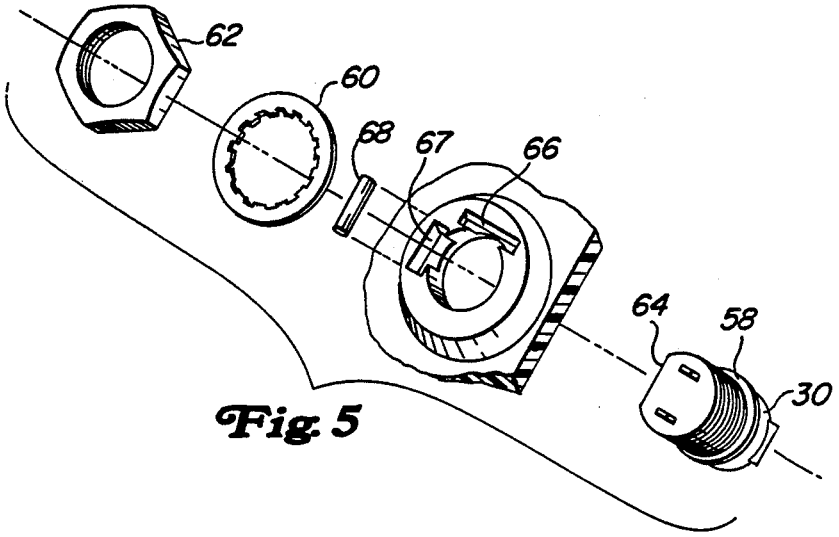
FIG. 5 is an exploded view of the adjustable mounting assembly for the switches.

Control handles 32 comprises a housing having a shaft portion 34 and a control face portion 36. The housing is formed from a plastic switch plate 38 and a plastic back plate 40, best illustrated in FIG. 3. Both of these plates are provided with external and internal surfaces. The plates are held together by a releasable securing means comprising three self-tapping screws 42, only one shown. The two screws not illustrated extend between the back plate and the control face portion of the switch plate.

A coupling means comprising a metallic elongated hexagonal member 44 is attached to the switch plate by two self-tapping screws 46. Member 44 is provided with three lateral apertures 48 in to which are received mounting posts 50 formed in the switch plate. In addition, to facilitate assembly, one of the apertures engages mounting post 52 extending from the back plate. Member 44 is also provided with a longitudinally extending internally threaded bore 54 which is screwed on the actuating levers. The handle is held in place on the actuating lever by a thrust washer (not shown) and lock nut 55. The metallic coupling member is adapted to take the thrust loads of the control handle.

Electrical control switches 56 are mounted to the control face portion of the switch plate. These switches are aircraft quality rocker switches such as those marketed by Otto Switch, of Chicago, Illinois. The switches are inserted through circular mounting holes 57 located in the switch plate. Each of the switches are provided with a mounting ring 58 that engages the external surface of the switch plate along the periphery of the mounting hole. Opposite the mounting ring is removable thrust washer 60 and clamping nut 62 which clamps the switch plate between the mounting ring and the thrust washer. In this way, the operator, by first orienting the switch, can lock it in place by tightening the lock washer.

Typically, the switch is provided with a flat surface 64 for identifying a specific mounting orientation. As the mounting hole is circular, the flat surface does not define a specific mounting orientations and as such, the switch can be located in a full range of mounting orientations. However, to facilitate assembly, two mounting orientations have been preselected. These preselected mounting orientations are perpendicular to one another and permit the operator to actuate the switch in either a vertical mode or a horizontal mode. More specifically, the switch plate is provided with two grooves 66 and 67 defining these orientations. A pin 68 is inserted into one of these grooves and cooperates with the flat surface of the switch to define either the horizontal or vertical mounting orientation. The pin is held in place by the lock washer trapping it in the groove.

The switch is provided with switch wires 70 that are coupled to terminal posts 72 integrally formed with the back plate. The terminal posts are provided with metallic dodge inserts that are sonically welded to the posts. The dodge inserts are provided with screws for securing the switch wires to the posts. A wiring harness 74 extends upwardly into the shaft portion of the housing and is provided with communication wires 76 that are secured to terminal posts 72. In this way, the communication wires are electrically coupled to the switch wires. The wiring harness is secured to the metallic coupling member by a tie band 78 that engages circumferential groove 80 formed in the coupling member.

Terminal posts 72 are located at different elevations relative to the back plate to reduce interference between the posts. In addition, the smallest posts are located in the lowermost portion to form a pocket or void in which excess wire can be accumulated.

In servicing the control handle, the lock nut and thrust washer locking the handle to the actuating levers are loosened so that the handle can be rotated on the actuating lever. Self-tapping screws 42 are removed and the back plate separated from the switch plate. The switch wires function hold the back plate to the switch plate during servicing. The terminal posts and switches can then be accessed for adjustment, repair and/or replacement as required.

We claim:

1. A control handle, the handle comprising:

a housing being formed from a back plate and a switch plate, the back plate and the switch plate both having internal and external surfaces;

releasable securing means for releasably securing the back plate to the switch plate;

at least one electrical switch mounted in the switch plate, the switch having an operator contact assembly that extends from the switch outwardly from the external surface of the switch plate;

a terminal post integrally formed with the back plate and extending inwardly from the internal surface of the back plate;

switch wires coupling the switch to the terminal post; and communication wires coupled to the terminal post and extending therefrom for connection to a work assembly, whereby when the releasably securing means in released, the back plate can be removed from the switch plate and the terminal post and switch can be readily accessed for servicing.

2. A control handle as defined by claim 1 wherein the switch plate is provided with a coupling means for coupling the control handle to an actuator lever.

3. A control handle as defined by claim 2 wherein the control handle is provided with at least two terminal posts, the first terminal post being at a different elevation from the second terminal post to reduce interference between the posts.

4. A control handle as defined by claim 3 wherein the means for releasable securing comprises at least one self-tapping screw.

5. A control handle as defined by claim 4 herein at least one self-tapping screw extends through the back plate, through the coupling means and into the switch plate.

6. A control handle as defined by claim 5 wherein the switch plate is provided with positioning towers formed in its internal surface that engage lateral apertures formed in the coupling means.

7. A control handle as defined by claim 6 wherein the coupling means is a metallic elongated member having an internal longitudinal threaded bore for receiving an actuator lever.

8. A control handle as defined by claim 7 wherein the switch is secured to the switch plate by an adjustable mounting means for orienting the operator contact assembly of the switch.

9. A control handle as defined by claim 8 wherein the adjustable mounting means is provided with two preselected mounting orientations.

10. A control handle as defined by claim 9 wherein the two preselected mounting orientations are defined by two grooves formed in the switch plate, a pin is located in one of the grooves and contacts a flat surface formed in the switch thereby selectively orienting the switch in the housing.

11. A control handle as defined by claim 10 wherein the adjustable mounting means is located adjacent to the internal surface of the switch plate so that it can be readily accessed when the back plate is removed from the switch plate.

12. A control handle as defined by claim 11 wherein the switch plate is provided with a shaft portion and a control face portion, the operator contact assembly of the switch extending from the control face portion.

13. A control handle as defined by claim 12 wherein the metallic elongated member is located in the shaft portion.

14. A control handle, the handle comprising:

a housing having a shaft portion and a control face portion;

at least two electrical switches mounted in the control face portion, the switches having an operator contact assembly that extends from the switch outwardly from the control face portion; and an adjustable mounting means for adjustably orienting the operator contact assembly of the switches, the adjustable mounting means is provided with two preselected mounting orientations, the two preselected mounting orientations are defined by two grooves formed in the switch plate, a pin is located in one of the grooves and contacts a flat surface formed in the switch thereby selectively orienting the switch in the housing.

15. A control handle as defined by claim 14 wherein the housing is formed from a switch plate from which the operator contact assembly extends and a back plate releasably secured to the switch plate by self-tapping screw, the back plate and the switch plate are provided with internal and external surfaces.

16. A control handle as defined by claim 15 wherein the adjustable mounting means is located adjacent to the internal surface of the switch plate so that it can be readily accessed when the back plate is removed from the switch plate.

* * * * *